US009978542B2

(12) United States Patent
Oley et al.

(10) Patent No.: US 9,978,542 B2
(45) Date of Patent: May 22, 2018

(54) CIRCUIT BREAKER LOCKOUT DEVICES AND METHODS

(71) Applicant: Huntington Ingalls, Inc., Newport News, VA (US)

(72) Inventors: Dennis Alan Oley, Lucedale, MS (US); Lawrence Edward Chambliss, Moss Point, MS (US)

(73) Assignee: Huntington Ingalls Incorporated, Newport News, VA (US)

( * ) Notice: Subject to any disclaimer, the term of this patent is extended or adjusted under 35 U.S.C. 154(b) by 497 days.

(21) Appl. No.: 14/211,311

(22) Filed: Mar. 14, 2014

(65) Prior Publication Data

US 2014/0262702 A1 Sep. 18, 2014

Related U.S. Application Data

(60) Provisional application No. 61/787,163, filed on Mar. 15, 2013.

(51) Int. Cl.
*H01H 9/28* (2006.01)

(52) U.S. Cl.
CPC ..... *H01H 9/283* (2013.01); *Y10T 29/49105* (2015.01)

(58) Field of Classification Search
CPC ..... H01H 9/28; H01H 9/281–9/283; H01H 9/286; Y10T 29/49105
USPC ..... 200/43.01, 43.11–43.16, 43.18–43.21
See application file for complete search history.

(56) References Cited

U.S. PATENT DOCUMENTS

| | | | | |
|---|---|---|---|---|
| 4,260,861 A * | 4/1981 | DiMarco | H01H 9/282 | 200/43.15 |
| 4,677,261 A * | 6/1987 | Nourry | H01H 9/283 | 200/43.01 |
| 4,733,029 A * | 3/1988 | Kobayashi | H01H 9/283 | 200/43.15 |
| 6,015,956 A * | 1/2000 | Green | H01H 9/283 | 200/43.14 |
| 2013/0056336 A1* | 3/2013 | Grul et al. | H01H 9/286 | 200/43.16 |

* cited by examiner

*Primary Examiner* — Edwin A. Leon
*Assistant Examiner* — Lheiren Mae A Caroc
(74) *Attorney, Agent, or Firm* — Hunton Andrews Kurth LLP

(57) ABSTRACT

Circuit breaker lockout devices are disclosed that effectively lock one or more circuit breakers in a circuit breaker panel in a safe or open circuit position. Embodiments of the circuit breaker lockout devices are robust, utilize few loose parts, and are easily installed. The devices are also short in profile, thereby allowing them to be installed in a circuit breaker panel having minimal clearance between the circuit breakers and a closed panel door cover.

13 Claims, 15 Drawing Sheets

CIRCUIT BREAKER LOCKOUT DEVICES AND METHODS

CROSS-REFERENCE TO RELATED APPLICATIONS

This patent application claims priority to U.S. Provisional Application No. 61/787,163, filed Mar. 15, 2013, and titled "Circuit Breaker Lockout Device," which is incorporated herein by reference in its entirety.

FIELD OF THE INVENTION

The field of the present invention relates generally to protective hardware for circuit breakers and methods of application.

BACKGROUND

Protective hardware is often necessary to isolate, secure, or block machines or equipment from energy sources during service of such equipment. Energizing or starting up machinery, equipment, or systems that are being serviced could endanger the person performing the service. For this reason, various electrical circuits at a circuit breaker location are switched to the off/open/safe position and retained in that position using various lockout devices for the duration of servicing operations. Presently many of the devices available on the market for circuit breaker lockout are not robust and lack reliability when functioning as a lockout device for various reasons, including improper fit or lack of sufficient rigidity to prevent operation of the breaker. Further, some devices do not have a low profile once installed and exceed a maximal clearance that is necessary for closure and/or continued operation of the circuit breaker panel door. Other devices have loose pieces that are cumbersome to manage during installation or removal of the devices.

Circuit breaker lockout devices are required that are more robust, can perform in a severe industrial environment, and that positively impede operation of a circuit breaker when in an off/open/safe position. Embodiments of the present invention overcome these and other problems of conventional circuit breaker lockout devices.

DETAILED DESCRIPTION OF THE INVENTION

Reference will now be made in detail to exemplary embodiments, examples of which are illustrated in the accompanying drawings. It should be appreciated that the same reference numbers will be used throughout the drawings to refer to the same or like parts. The following description is intended to convey a thorough understanding of the embodiments described by providing a number of specific embodiments. It should be appreciated that the following detailed descriptions are exemplary and explanatory only and are not restrictive. As used herein, any term in the singular may be interpreted to be in the plural, and alternatively, any term in the plural may be interpreted to be in the singular.

The description below provides embodiments of various circuit breaker lockout devices. Several of these embodiments have two pieces that are attached together and which prevent a circuit breaker switch from traveling from an off/open/safe (hereinafter "open") position to an on/closed (hereinafter "closed") position. The two pieces may be attached at a hinge and may be further secured together with a lock (such as a padlock or tie) to prevent separation of the two pieces and removal from the circuit breaker. Each of the two pieces may also comprise a lip that is configured to slide under a circuit breaker panel at a cutout in the panel for the circuit breaker switch. The lip of each piece may slide under the panel before the two pieces can be locked together and secured to the circuit breaker and around or atop the circuit breaker switch. Once secured to each other and to the circuit breaker, the two pieces effectively prevent the circuit breaker switch from traveling from the open position to the closed position, thereby isolating a load (e.g., machine) from the energy source and preventing the breaker from being closed while the device is in place.

The embodiments disclosed herein are component assemblies of a circuit breaker lockout device which may be installed beside or on top of the circuit breaker switch, and when employed prevent the breaker from traveling into the closed position. The devices can easily be installed in a circuit breaker panel having minimal clearance between the circuit breaker devices and the panel door cover.

Figure 1A:
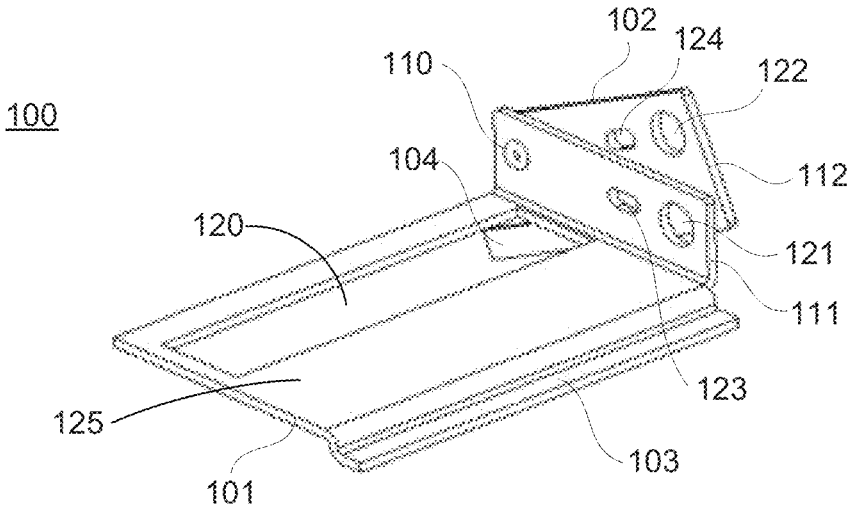
FIGS. 1*a*-1*b* depict an exemplary blade-type lockout device, according to a first exemplary embodiment.
Figure 1B:
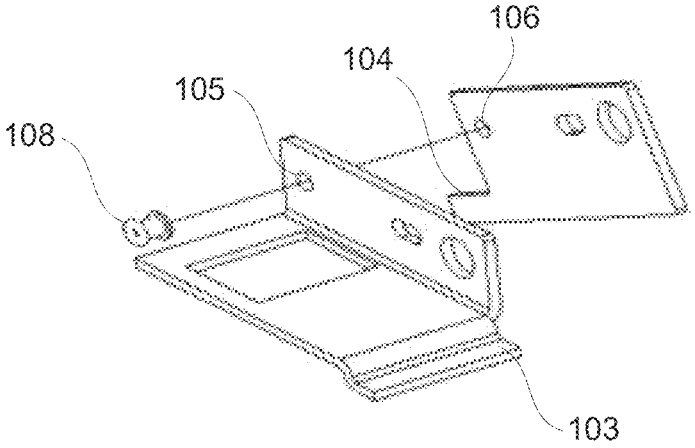
Figure 2:
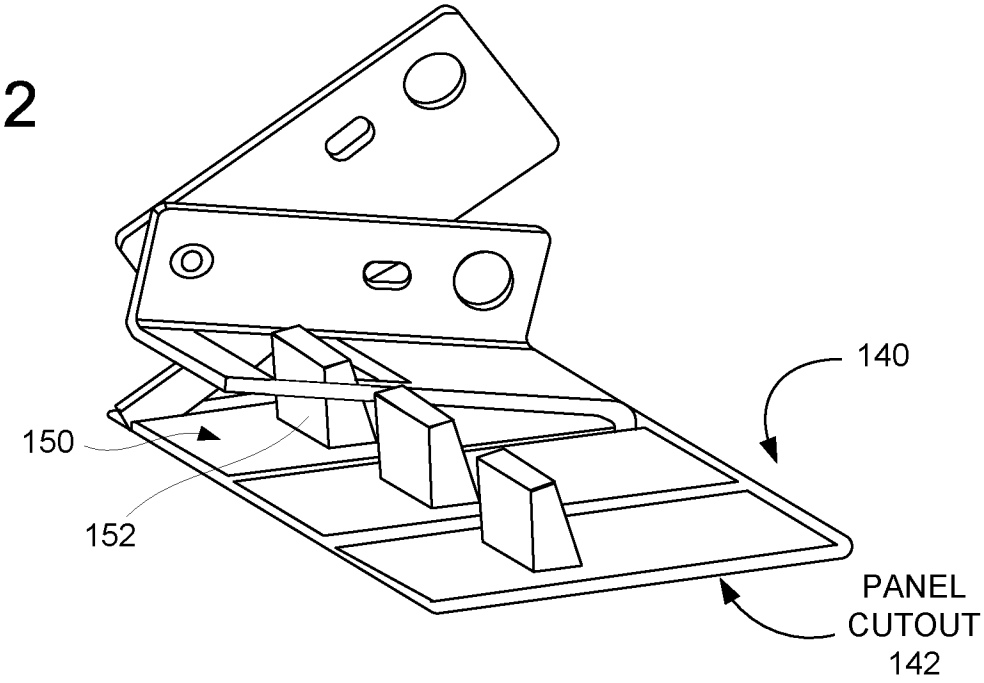
FIG. 2 depicts an exemplary blade-type lockout device during installation, according to the first exemplary embodiment of the invention.
Figure 3:
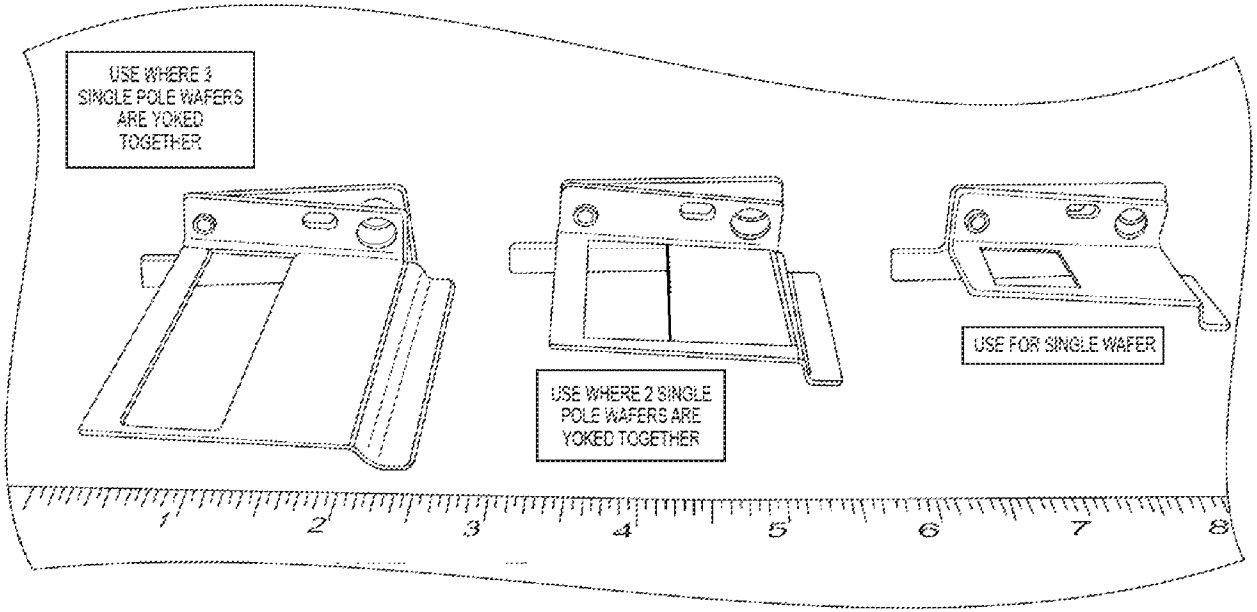
FIG. 3 depicts different sizes of the blade-type lockout device, according to the first exemplary embodiment of the invention.

FIGS. 1-3 show a first embodiment of the invention. The circuit breaker lockout device of FIG. 1 is in the form of a "blade"-type lockout device 100. The blade lockout device 100 is an assembly made from two pieces (primary piece 101 and secondary piece 102) which are joined by a fastener 108 (such as a rivet, FIG. 1*b*), which acts as a hinge 110. The assembly has a swing arm 102 that swings past arm 111 of primary piece 101 about hinge 110. The primary piece 101 comprises a planar portion 125 that extends over the circuit breaker when installed and an arm portion 111 that extends orthogonally from the planar portion 125. The primary piece 101 further comprises a lip 103 that is out-of-plane with the planar portion 125, but which may be parallel to planar portion 125. Lip 103 protrudes from one end of the primary piece 101 and, upon installation, is configured to slide under a circuit breaker panel 140 (area around cutout 142 in FIG. 2) at a cutout 142 that houses one or more circuit breaker switches 150. After installation, lip 103 is configured to reside under panel 140 and the planar portion 125 of the primary piece 101 resides over a portion of the one or more circuit breakers 150 (FIG. 2) and parallel to (but slightly elevated above) panel 140. As shown in FIG. 2, the lip 103 of primary piece 101 may be positioned at the "ON" or closed side of the circuit breaker 150, but the configuration may be reversed. Primary piece 101 has a cutout 120 for the circuit breaker switch lever 152, and cutout 120 is sized so as to lock switch lever 152 in one position—the open position—and prevent movement of the switch lever 152 into a closed position. The primary piece 101 also comprises other openings, such as hole 105 for fastener 108 (such that hinge 110 may be formed) and hole 121 for securing the primary piece 101 to the secondary piece 102 in an installed position with a locking device (such as a padlock or tie wrap). A hole 123 may also be formed in the primary piece 101 for additional purposes, such as retaining an explanatory tag. A tag may be used to explain who installed the lockout device 100, a purpose for the installation, when the lockout device 100 will be removed, and any other information such as cautionary information.

The secondary piece 102 may be planar and function as a swing arm about hinge 110. On one side of secondary piece 102 is a blade tip 104 (or lip) which protrudes from swing arm 101, but which may be planar with the secondary piece 102. During installation, lip 104 is configured to slide under circuit breaker panel 140 at a cutout 142 that houses the one or more circuit breaker switches 150. After installation, lip 104 is configured to reside under panel 140 and the remainder of the secondary piece 102 resides adjacent to the one or more circuit breakers 150 (FIG. 2) and orthogonal to panel 140. As shown in FIG. 2, the lip 104 may be positioned at the "OFF" or open side of the circuit breaker, but the configuration may be reversed. The secondary piece 102 may also comprise other openings, such as hole 106 for fastener 108 (such that hinge 110 may be formed) and hole 122 for securing the primary piece 101 to the secondary piece 102 in an installed position with a locking device (such as a padlock or tie wrap). A hole 124 may also be formed in the secondary piece 102 for additional purposes, such as retaining an explanatory tag. Once installed, holes 121 and 122, 123 and 124, respectively, may line up to allow for insertion of the locking device or explanatory tag. Fastener 108 may be inserted into holes 105 and 106 to secure the primary and secondary devices 101, 102 together, even before installation. In this manner, lockout device 100 does not have any loose pieces to manage during installation, which could make installation cumbersome.

Lockout device 100 may be fabricated from sheet metal, and may be thin while retaining sufficient rigidity. Because it is thin, the lip 103 of the primary piece 101 can easily be slid between the circuit breaker 150 and the panel 140 on one side of the breaker 150 (e.g., the "ON" side), while lip 104 can swing into place behind/under the panel 140 on the other side of the circuit breaker 150 (e.g., the "OFF" side). Advantageously, lockout device 100 can be implemented without a change to the design of the panel 140 in which the device is deployed. Moreover, arm portion 111 of primary piece 101 and the secondary piece 102 may be sized to satisfy a maximal clearance such that a panel door may still be closed over panel 140 after installation of lockout device 100, to provide further lockout and protection of circuit breakers 150.

Lockout device 100 may be employed in low voltage panels providing lighting and receptacle power (similar to a standard house panel) where the breakers are thin, do not have a dedicated panel cutout, and where multiple pole breaker functionality is accomplished by ganging multiple single pole breakers (wafers) together.

Illustrative blade-type lockout devices according to FIGS. 1*a*-1*b* and 2 are shown in the picture in FIG. 3. As can be seen, the blade-type lockout device may be employed to lockout one or more circuit breaker switches (e.g., 1, 2, or 3) on a circuit breaker in a panel where the cutout in the panel shield is common to several breakers. Any of multiple sizes may be used for single pole single phase circuits, double pole single phase circuits, and three pole three phase circuits, for example. Three sizes configured to accommodate single, double or triple stacks of single pole breakers are shown in FIG. 3.

Figure 4:
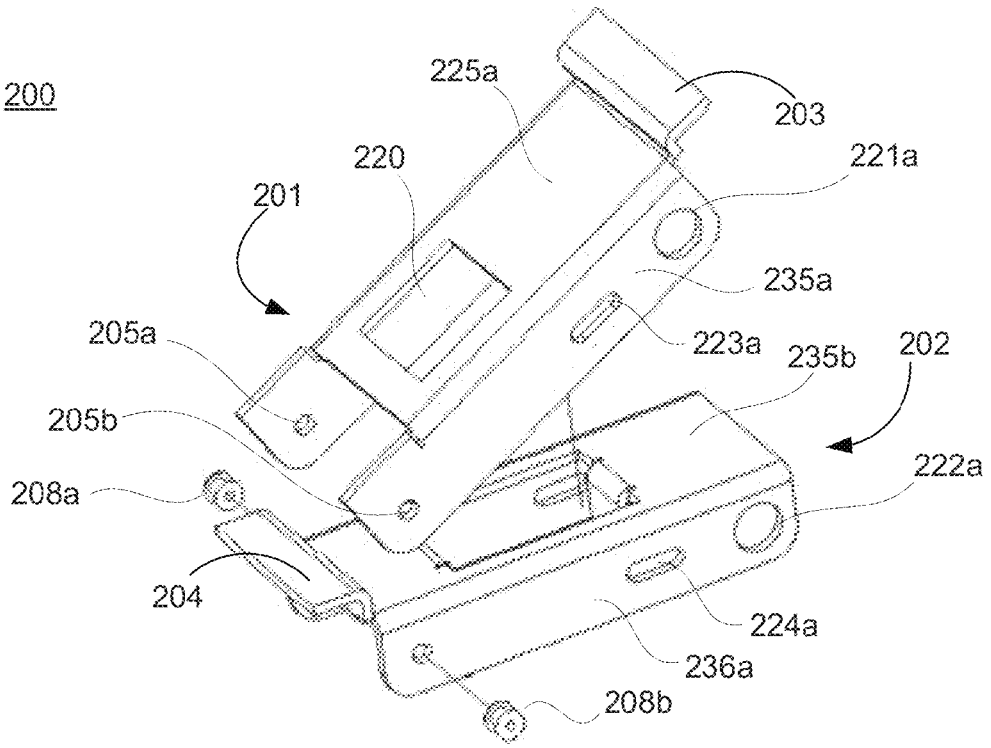
FIG. 4 depicts an exemplary lever-type lockout device, according to a second exemplary embodiment of the invention.
Figure 5:
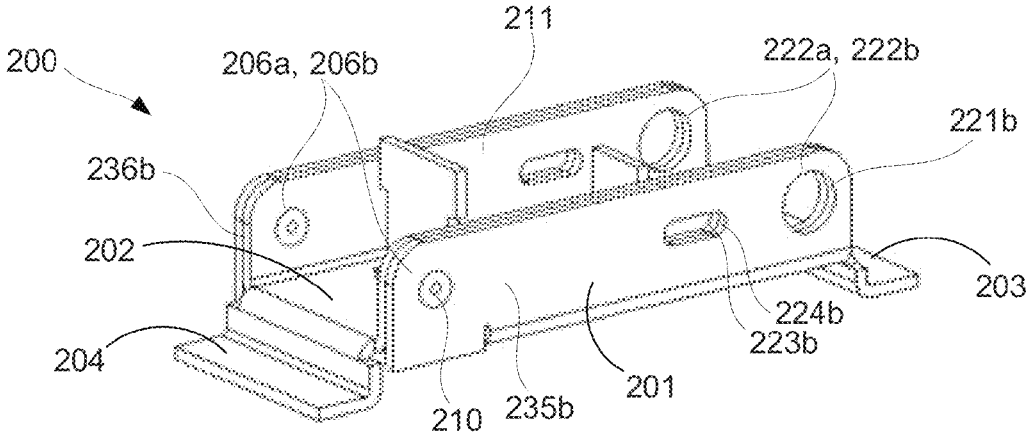
FIG. 5 depicts another orientation of the lever-type lockout device, according to the second exemplary embodiment of the invention.
Figure 6:
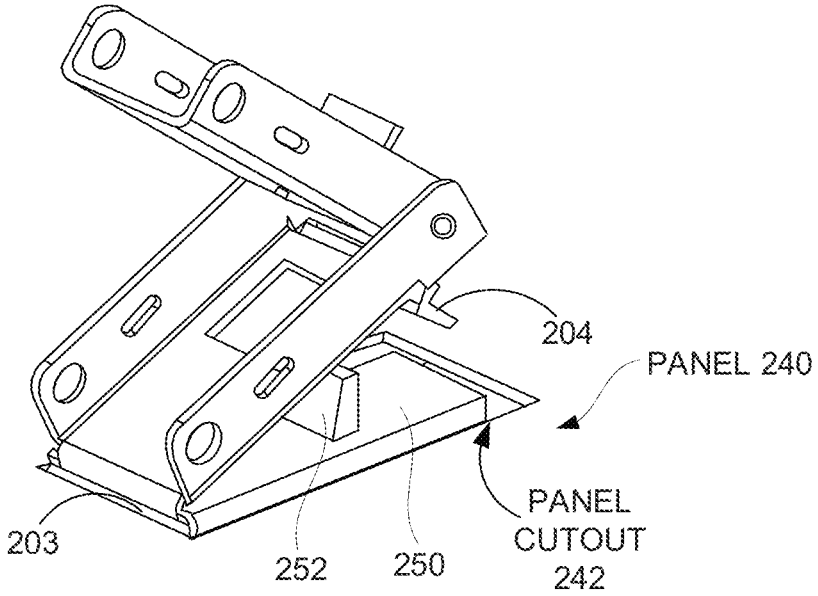
FIG. 6 depicts an exemplary lever-type lockout device during installation, according to the second exemplary embodiment of the invention.
Figure 7:
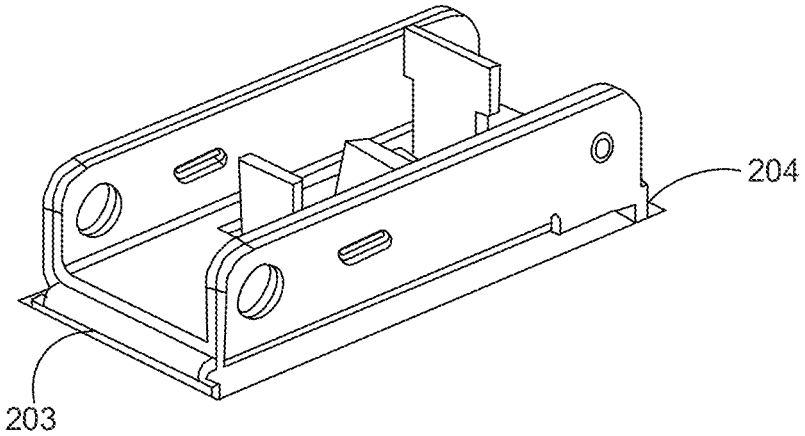
FIGS. 7-8 depict an exemplary installed lever-type device, according to the second exemplary embodiment of the invention.

FIGS. 4-8 show a second embodiment of the invention. The circuit breaker lockout device shown in FIG. 4 is in the form of a "lever" style lockout device 200, which is an assembly made from two pieces (201, 202) joined with one or more fasteners (208*a*, 208*b*) (e.g., rivets) which act as a hinge for actuating the "lever." The lockout device 200 in FIG. 4 is shown upside down for explanatory purposes. The assembly has a primary or lower piece 201 and a secondary or upper piece 202. The primary piece 201 comprises a planar portion 225*a* and a first lip or flange 203 out-of-plane with the planar portion 225*a*, as shown in FIG. 4. First lip 203 protrudes from one end of the primary piece 201 and, upon installation, is configured to slide under a circuit breaker panel 240 (FIG. 6) at a cutout 242 that houses one or more circuit breaker switches 250. After installation, lip 203 is configured to reside under panel 240 and the planar portion 225*a* of the primary piece 201 resides over a portion of the circuit breaker 250 and parallel to (but slightly elevated above) panel 240. As shown in FIG. 7, lip 203 of primary piece 201 may be said to be positioned at the "ON" or closed side of the circuit breaker, but the configuration may be reversed. Primary piece 201 has a cutout 220 for the circuit breaker switch lever 252, and cutout 220 is sized so as to lock switch lever 252 in one position—the open position—and prevent movement of the switch lever 252 into a closed position. Primary piece 201 may also comprise other openings, such as holes 205*a* and 205*b* for fasteners

208*a* and 208*b* (such that hinge 210 may be formed) and holes 221*a*, 221*b* for securing the primary piece 201 to the secondary piece 202 in an installed position with one or more locking devices (such as padlock(s) or tie wrap(s)). Holes 223*a*, 223*b* may also be formed in the primary piece 201 for additional purposes, such as retaining an explanatory tag or an additional locking device. A tag may be used to explain who installed the lockout device 200, a purpose for the installation, when the lockout device 200 will be removed, and any other information such as cautionary information, for example.

The secondary or upper portion 202 may comprise a planar portion 235*b* and a second lip or flange 204. Lip 204 is out-of-plane with and protrudes from planar portion 235*b*. During installation, lip 204 is configured to slide under circuit breaker panel 240 at a cutout 242 that houses the one or more circuit breaker switches 250. After installation, lip 204 is configured to reside under panel 240 and the remainder of secondary piece 202 resides above and about the one or more circuit breakers 250. As shown in FIGS. 6-7, lip 204 may be said to be positioned at the "OFF" or open side of the circuit breaker, but the configuration may be reversed. The secondary piece 202 may also comprise other openings, such as holes 206*a*, 206*b* for fasteners 208*a*, 208*b* (such that hinge 210 may be formed) and holes 222*a*, 222*b* for securing the primary piece 201 to the secondary piece 202 in an installed position with one or more locking devices (such as padlock(s) or tie wrap(s)). Holes 224*a*, 224*b* may also be formed in the secondary piece 202 for additional purposes, such as retaining an explanatory tag or an additional locking device, as explained above. Once installed, holes 221*a* and 222*a*, 221*b* and 222*b*, may line up to allow for insertion of the one or more locking devices, and holes 223*a* and 224*a*, 223*b* and 224*b*, may line up to allow for insertion of one or more explanatory tags or an additional locking device. Fasteners 208*a*, 208*b* may be inserted into holes 205*a*, 206*a*, and 205*b*, 206*b*, respectively, to secure the primary and secondary pieces 201, 202 together, even before installation. In this manner, lockout device 200 does not have any loose pieces to manage during installation, which could make installation cumbersome.

Figure 8:
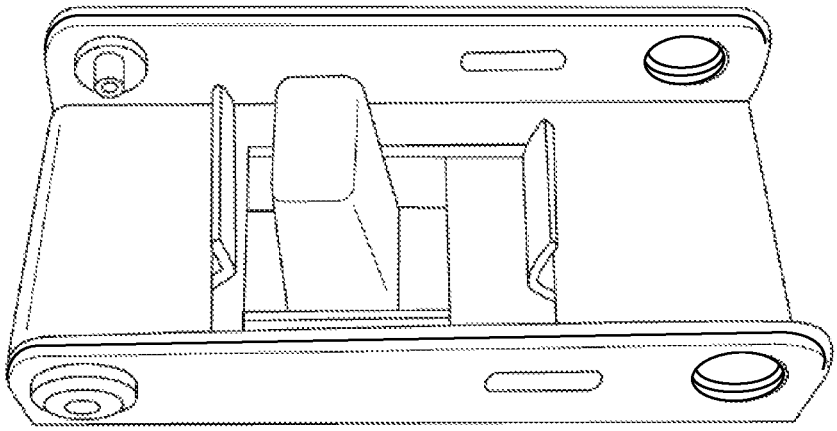

The lever lockout device 200 is installed by opening the device and aligning lips 203, 204 in the joint where the panel 240 meets the breaker body 250 at opposing ends of the circuit breaker throw positions (FIGS. 6-7) as the "lever" is actuated (i.e., device 200 is moved to the closed position such that the primary and secondary pieces come together). The design can be easily tailored to any single circuit breaker 250 or may be configured to be applied to multiple circuit breakers at once. FIGS. 7 and 8 illustrate (by drawing and photo, respectively) the lever lockout device 200 installed in the panel 240.

This lever-type lockout device 200 may be used, for example, in larger circuit breakers that are more sparsely populated in a panel 240 having a single cutout 242 for each individual breaker 250 that penetrates the panel 240. Advantageously, lockout device 200 can be implemented without a change to the design of the panel 240 (or switchboard) in which the device is deployed. This style of lockout device may be employed, for example, on an individual three phase circuit breaker (i.e., the breakers are not ganged together with a yoke). Lockout device 200 may also be fabricated from sheet metal, such that it is thin and fairly rigid. Because it is thin, lips 203 and 204 can easily slide between the circuit breaker 250 and the panel 240 on opposing ends of the panel cutout 242 to reside beneath the panel 240 in a manner similar to the previous embodiment. Moreover, orthogonal portions 235*a*, 235*b* of primary piece 201 and orthogonal portions 236*a*, 236*b* of secondary piece 202 may be sized to satisfy a maximal clearance such that a panel door may still be closed over panel 240 with lockout device 200 installed, to provide further lockout and protection of circuit breakers 250.

Figure 9:
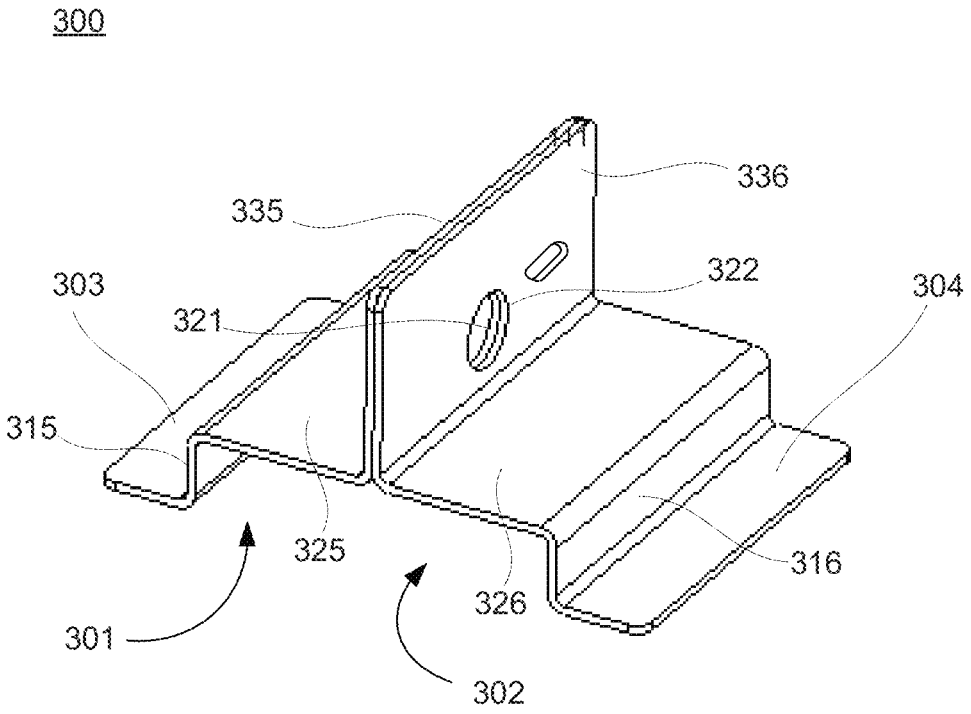
FIG. 9 depicts an exemplary clam shell-type lockout device, according to a third exemplary embodiment of the invention.

FIGS. 9-12 show a third embodiment of the invention. The circuit breaker lockout device 300 of FIG. 9 is in the form of a "clam shell." The clam shell lockout device 300 is an assembly made from two pieces—primary piece 301 and secondary piece 302—which are joined together with one or more locking devices (such as a padlock or tie wrap). The primary piece 301 comprises a first orthogonal portion 315, a planar portion 325 that extends over a portion of the circuit breaker when installed, and a second orthogonal portion 335 that extends orthogonally from planar portion 325. The primary piece 301 further comprises a lip 303 that is out-of-plane with the planar portion 325, but which may be parallel to planar portion 325 and orthogonal to the first orthogonal portion 315. Lip 303 protrudes from the first orthogonal portion 315 and, upon installation, is configured to slide under a circuit breaker panel 340 at a cutout 342 that houses one or more circuit breaker switches 350. After installation, lip 303 is configured to reside under panel 340 and the planar portion 325 of the primary piece 301 resides over a portion of the one or more circuit breakers 350 and parallel to (but slightly elevated above) panel 340. Primary piece 301 may comprise one or more openings, including hole 321 for a locking device (such as a padlock or tie wrap). Other openings may also be formed in primary piece 301, such as for an explanatory tag, as explained above.

The secondary piece 302 may be formed in the same shape as primary piece 301. The secondary piece 302 comprises a first orthogonal portion 316, a planar portion 326 that extends over a portion of the circuit breaker when installed, and a second orthogonal portion 336 that extends orthogonally from planar portion 326. The secondary piece 302 further comprises a lip 304 that is out-of-plane with the planar portion 326, but which may be parallel to planar portion 326 and orthogonal to the first orthogonal portion 316. Lip 304 protrudes from the first orthogonal portion 316 and, upon installation, is configured to slide under a circuit breaker panel 340 at a cutout 342 that houses one or more circuit breaker switches 350. After installation, lip 304 is configured to reside under panel 340 and the planar portion 326 of the secondary piece 302 resides over a portion of the circuit breaker 350 and parallel to (but slightly elevated above) panel 340. Secondary piece 302 may comprise one or more openings, including hole 322 for a locking device (such as a padlock or tie wrap). Other openings may also be formed in secondary piece 302, such as for an explanatory tag, as explained above.

The clam-shell design is easily scaled for broad applicability for various breaker manufacturers and frame sizes. This embodiment may be used in larger circuit breakers that are more sparsely populated in a panel having a single cutout for each individual breaker toggle switch handle which penetrates the panel. A major advantage of this design is that it can be implemented without a change to the design of the panel (or switchboard) in which the device is deployed.

Figure 10:
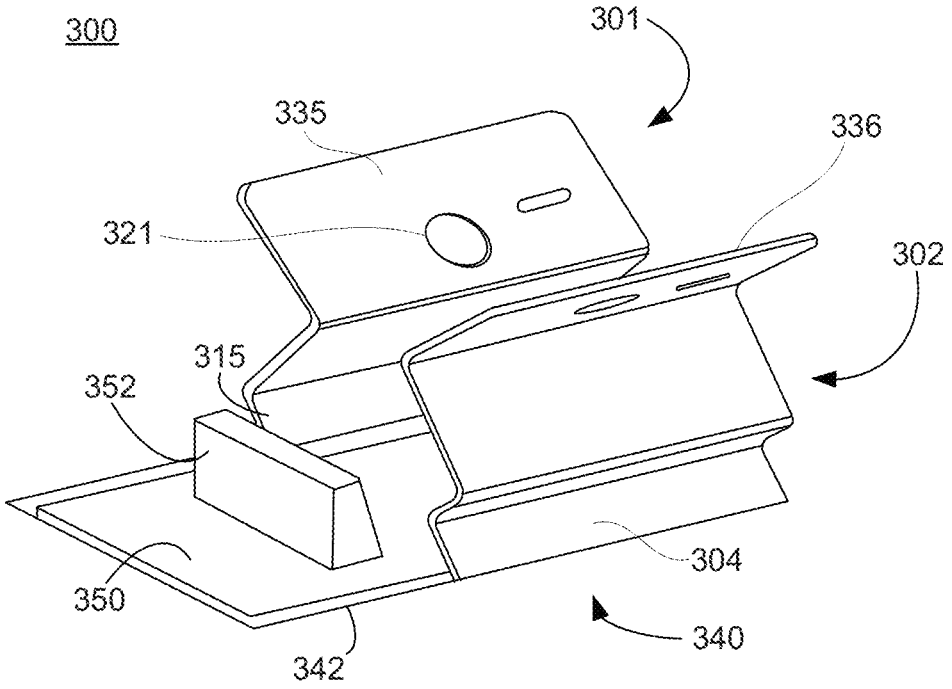
FIG. 10 depicts an exemplary clam shell-type lockout device during installation, according to the third exemplary embodiment of the invention.
Figure 11:
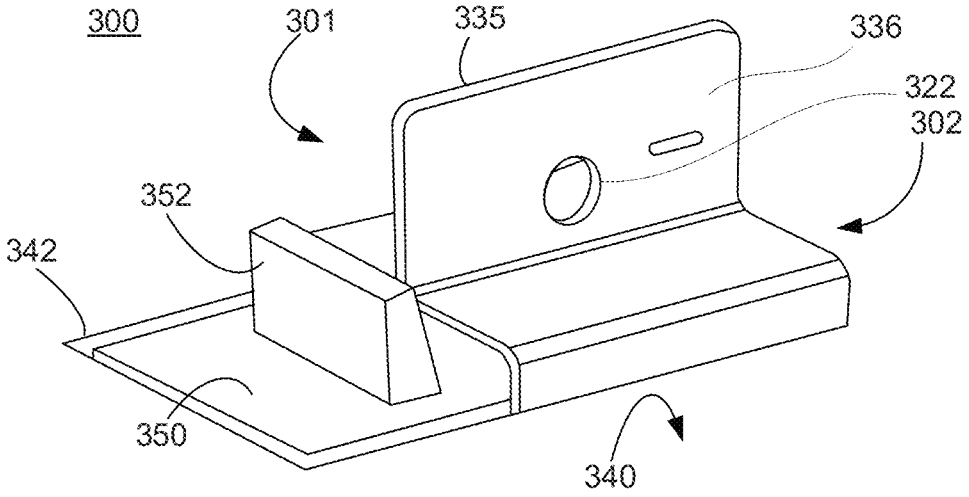
FIGS. 11-12 depict an exemplary installed clam shell-type device, according to the third exemplary embodiment of the invention.
Figure 12:
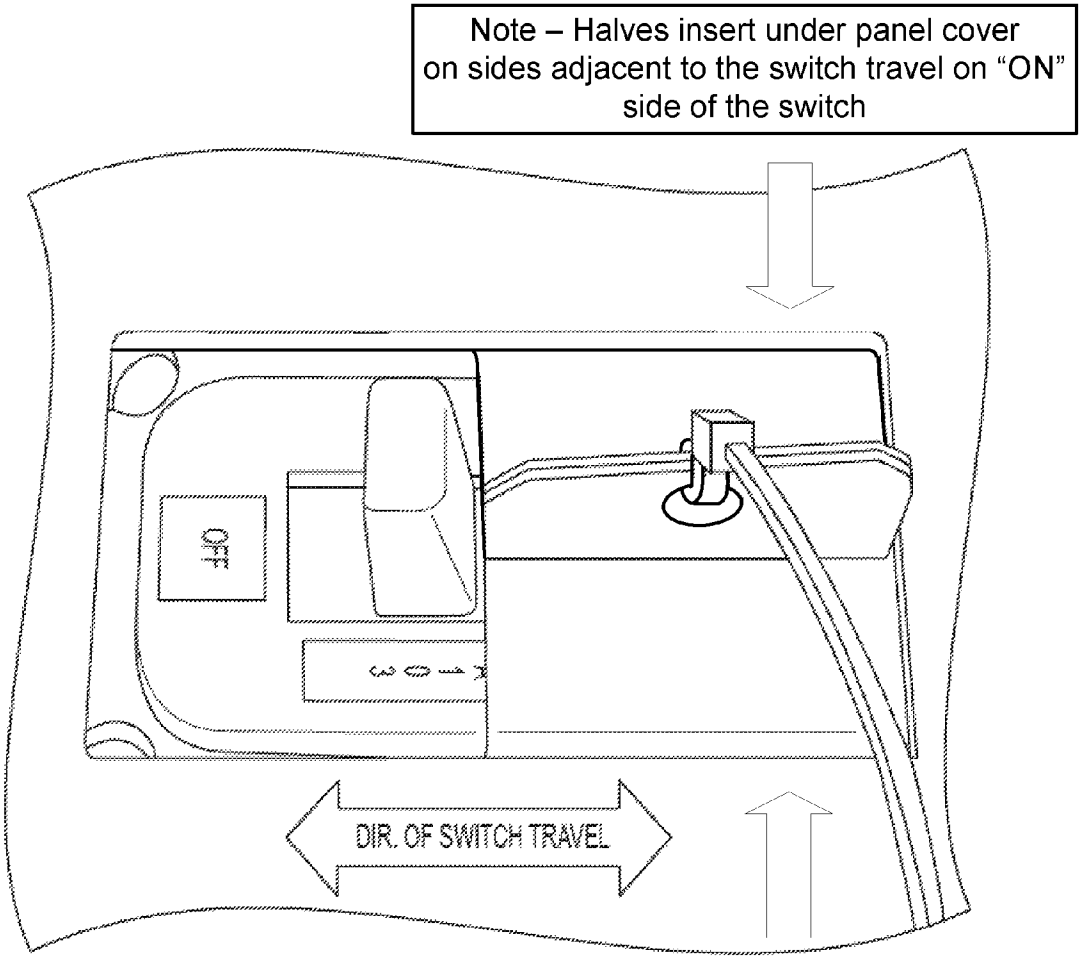

The clam shell lockout device 300 may be fabricated from sheet metal to be thin but fairly rigid. As shown in FIG. 10, the device 300 may be inserted in the path of a circuit breaker switch 252 by first inserting the lip 303 of the primary piece 301 between the breaker casing and the panel 240 on one side of the breaker 250, then inserting the lip 304 of the secondary piece 302 between the breaker casing and the panel 240 on the opposing side of the breaker 350. The orthogonal portions 335, 336 of the two halves are then brought together with the locking holes 321, 322 in registration such that a padlock or tie wrap (FIG. 12) can be installed through the holes 321, 322 to secure the device 300 in place over a portion of the circuit breaker 250. With a locking device installed, the circuit breaker switch 352 is prevented from traveling to the opposite position—in this case, the closed or "ON" position.

Due to its simplicity, the clam shell lockout device 300 may be manufactured inexpensively and can be easily modified to suit different breaker designs. The design can be tailored easily to any single breaker or multiple breakers having a dedicated rectangular cutout in the panel shield for the breaker being secured. A variation could also be used to span multiple breakers positioned within such a rectangular cutout.

Figure 13:
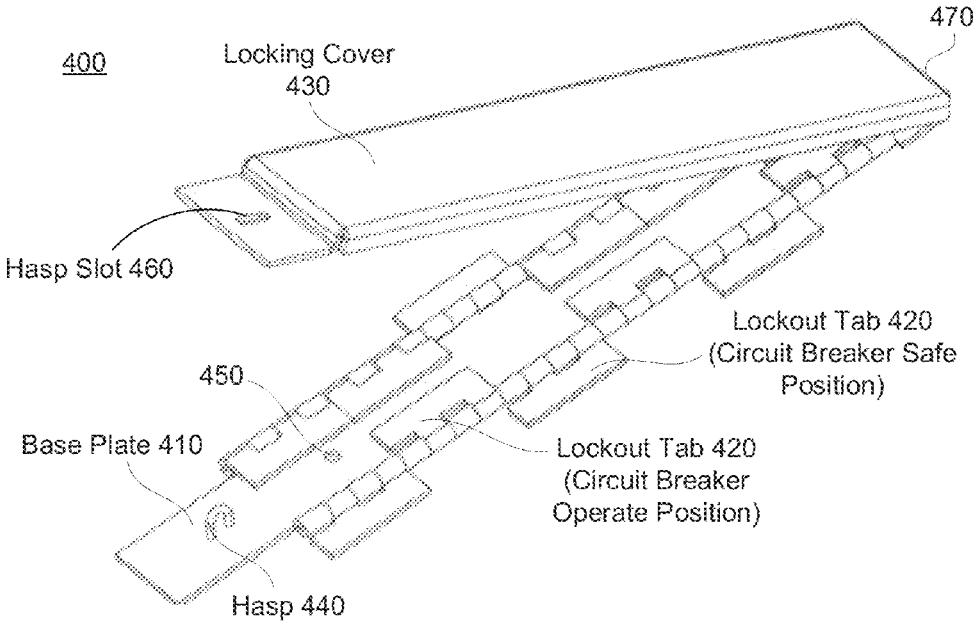
FIG. 13 depicts an exemplary lockout device, according to a fourth exemplary embodiment of the invention.
Figure 14:
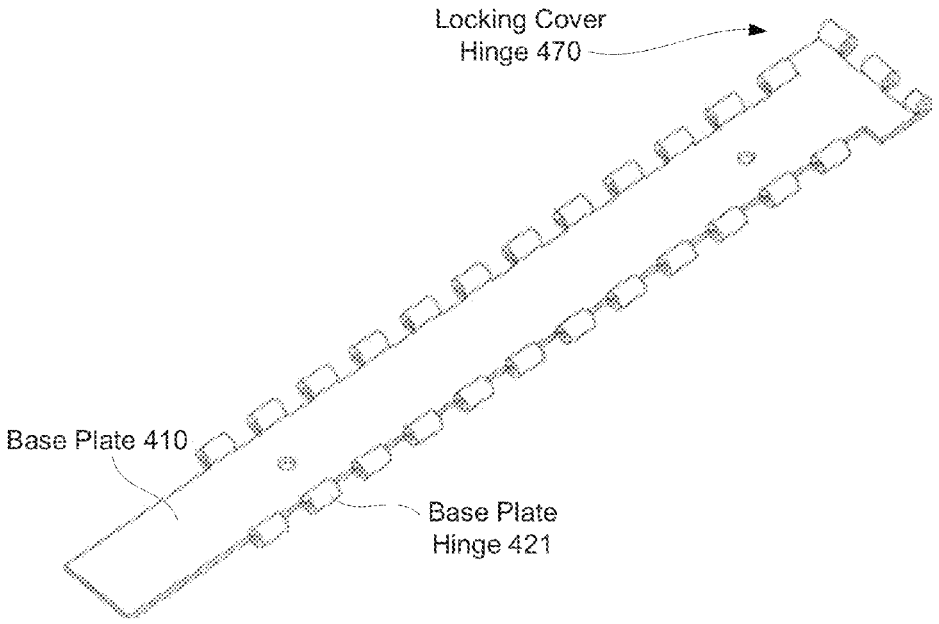
FIG. 14 depicts an exemplary base portion of the lockout device according to the fourth exemplary embodiment of the invention.
Figure 15:
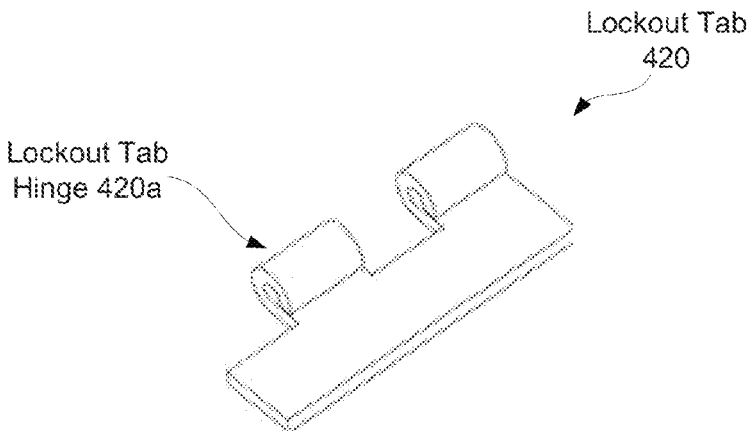
FIG. 15 depicts an exemplary tab portion of the lockout device according to the fourth exemplary embodiment of the invention.

FIGS. 13-20 show a fourth embodiment of the invention. The circuit breaker lockout device 400 of FIG. 13 is made up of three parts or subassemblies: 1) a base plate 410 subassembly (FIG. 14) which secures the device 400 to the panel front (not shown) and is the attachment point for other parts of the assembly; 2) hinged lockout tabs 420 (FIG. 15) that rotate about a hinge into either of two positions, and which allow the circuit to be either "safely secured" (e.g., in an open position) or allow it to "operate normally," (such that the circuit breaker switch can move between an open and closed position); and 3) a locking cover subassembly 430 (FIG. 16) which is a cover attached to the base plate 410 and secured into place over the hinged tabs 420 capturing them in either position (i.e., either "safely secured" or "operate normally"). Device 400 may be installed adjacent to a row of circuit breakers, or between two rows of circuit breakers, such that lockout tabs 420 may effectively lock one or more circuit breaker switches in an open position when lockout tabs 420 are in the "safe position" (FIG. 13).

Figure 17:
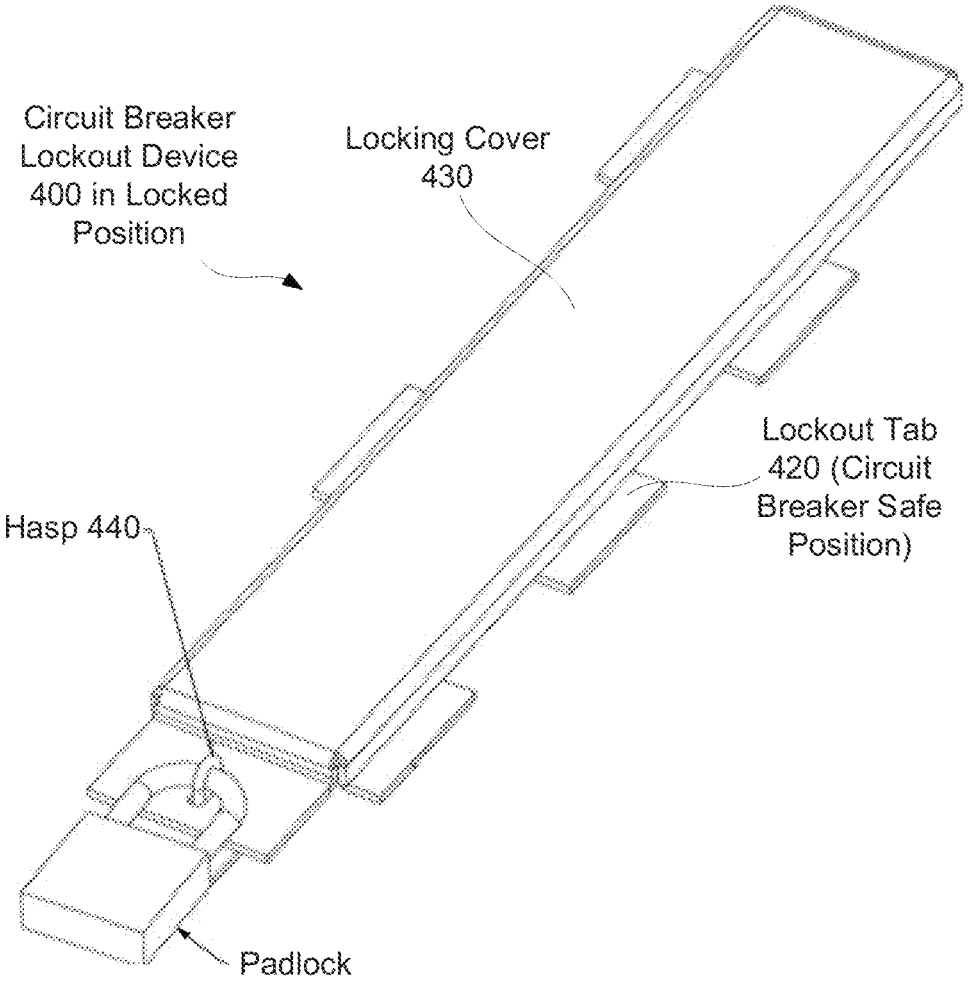
FIG. 17 depicts an exemplary lockout device in a locked position according to the fourth exemplary embodiment of the invention.

The circuit breaker lockout device 400 can be locked by inserting a locking device (such as a padlock or tie wrap) through a hasp 440 which comes through a hasp slot 460 on the locking cover subassembly 430, from the base plate subassembly, thereby securing the cover 430 in the "locked" position (FIG. 17).

The base plate subassembly is the component which physically integrates with the other sub-assemblies and secures the circuit breaker lockout device 400 to a front of the circuit breaker panel. The base plate 410 can be attached to the panel front by any means including double sided tape, sheet metal screws, or by introducing mounting holes 450 into the base plate which may align with existing fasteners on the panel front (not shown). The base plate 410 comprises a hasp 440 (or hasp ring) which feeds through a hasp slot 460 in the hinged locking cover subassembly 430.

Figure 18:
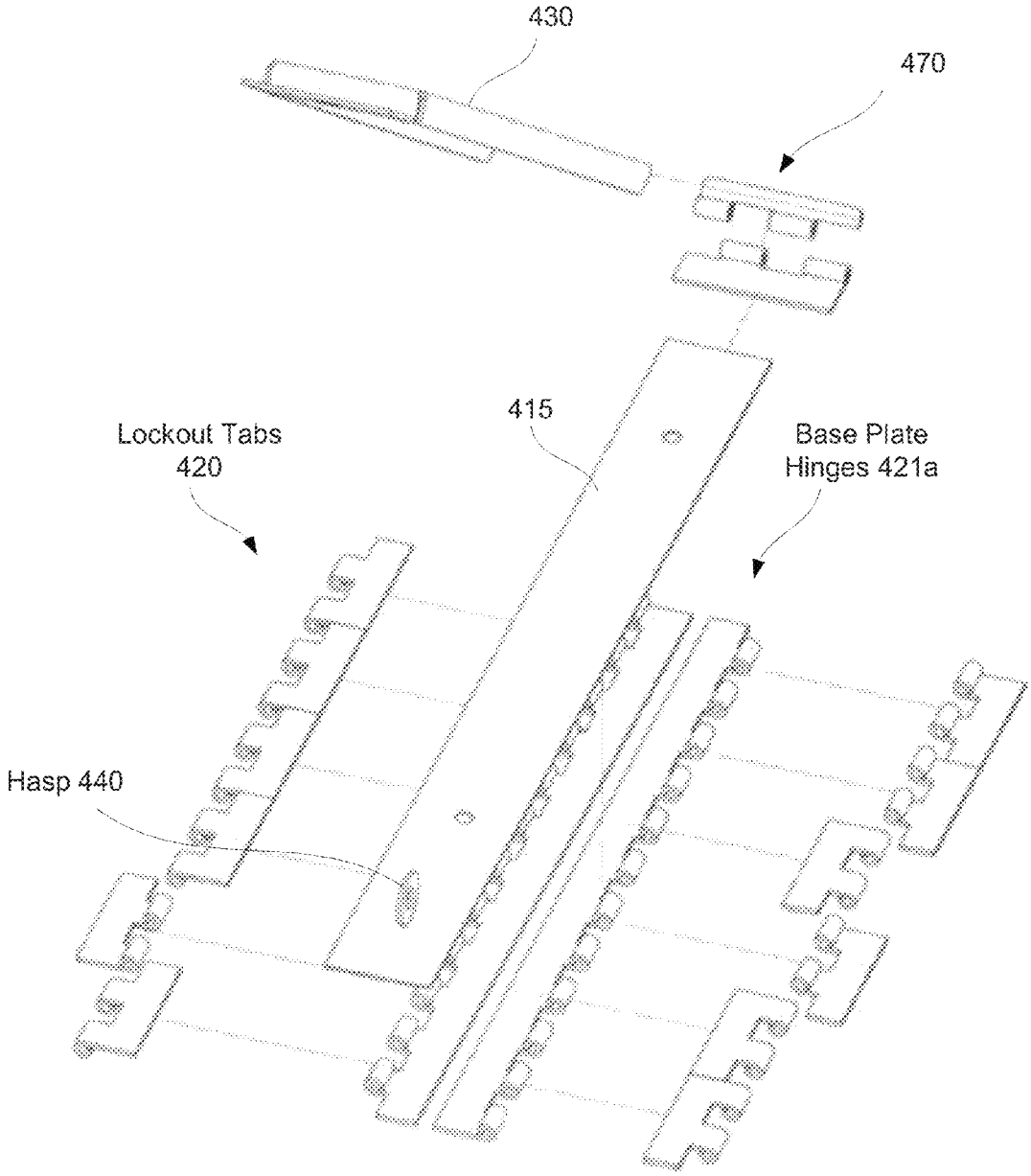
FIG. 18 depicts an exemplary secondary base portion of the lockout device according to the fourth exemplary embodiment of the invention.

The hinged lockout tabs 420 are simple hinges that attach to the base plate 410 with lockout tab hinges 420*a*, base plate hinges 421, and a hinge pin 422. An operator has the ability to change the position of each hinged tab 420 such that each tab 420 can be positioned either: (a) toward the circuit breaker switch lever in the path of the circuit breaker lever's travel, thereby preventing the circuit from being energized by not allowing the breaker to move to the open position (the "safe" tab position); or (b) spaced apart from the circuit breaker lever and out of the path of travel thereby allowing the breaker to move to the closed position (the "operate" tab position). The hinged lockout tabs 420 can either be unique tabs which are individually attached to the base plate subassembly or can be fabricated from a continuous hinge 421*a* in a single subassembly which can be attached to the base plate 410, as depicted in FIG. 18. The individual tabs 420 may be made by cutting a continuous hinge 421*a* such that individual tabs 420 are created and then are able to operate independently to protect each circuit breaker individually. Single or multiple hinge pins 422 (FIG. 20) may be used to hold the tabs 420 in place and for pivoting the tabs 420 between their safe and operate positions.

The locking cover subassembly 430 is the outer cover of the circuit breaker lockout device 400 which serves two purposes: (a) to capture and secure the hinged tabs 420 in either the "safe" or the "operate" positions (FIG. 17), and (b) to provide a positive locking feature preventing access to the hinged tabs 420 such that only an authorized individual with a key or combination (in the case of a padlock) can gain access to the lockout device 400. The locking cover subassembly 430 comprises a hasp slot 460 to allow a hasp 440 or staple to pass through the cover 430 from the base plate 410 such that a locking device can be installed (FIG. 17) to provide a secured, protected panel that only an authorized person can access by removing the locking device.

The locking cover subassembly 430 can be fabricated from sheet metal by forming two 90 degree sides on it to make a channel shape and a step on the end to form an integral portion for the locking hasp slot 460. The width of the locking cover subassembly 430 may be selected to secure and cover a portion of the lockout tabs 420 in the "safe" position, and a length of cover 430 may be long enough to secure and cover a portion or all of the lockout tabs 420 for all of the circuits. Attachment of the locking cover subassembly 430 to the base plate 410 may be accomplished via a hinge 470 at one end of the base plate 410 and a hinge barrel 471 at one end of cover 430. An advantage of a hinged locking cover subassembly 430 and hinged lockout tabs 420 for circuit breaker lockout is that the parts do not have to be removed from the panel while changing the status of the circuit breaker switch (from closed to open or from open to closed). Accordingly, parts are less likely to be lost and installation is less cumbersome.

Figure 16:
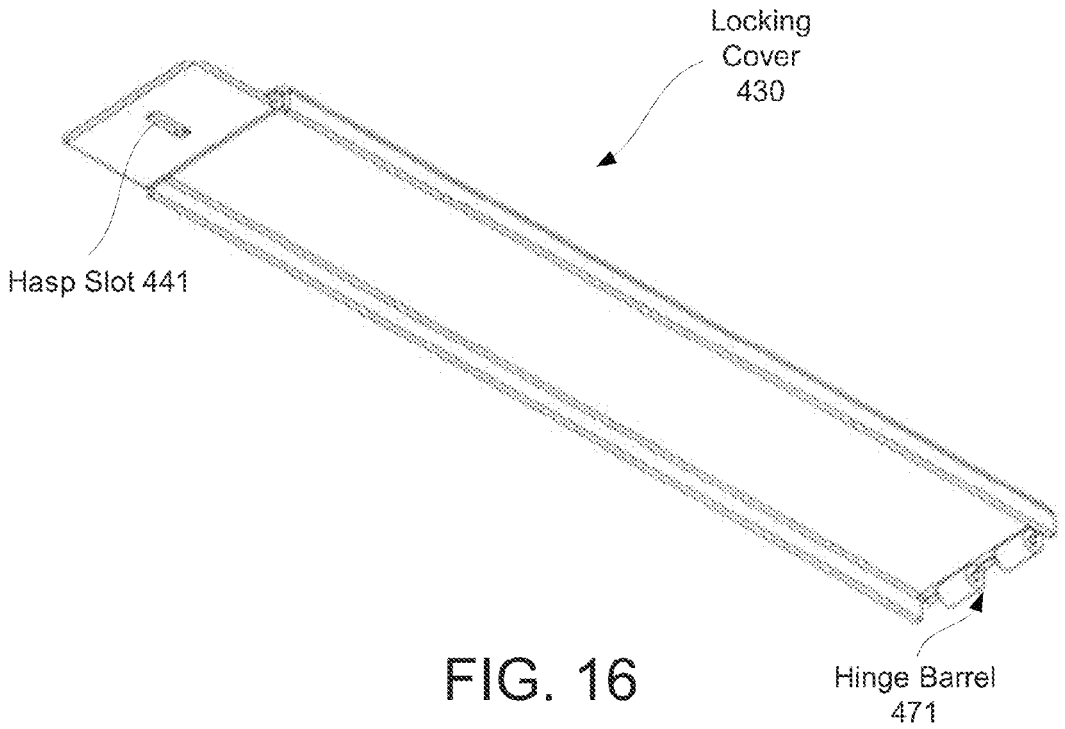
FIG. 16 depicts an exemplary cover portion of the lockout device according to the fourth exemplary embodiment of the invention.
Figure 19:
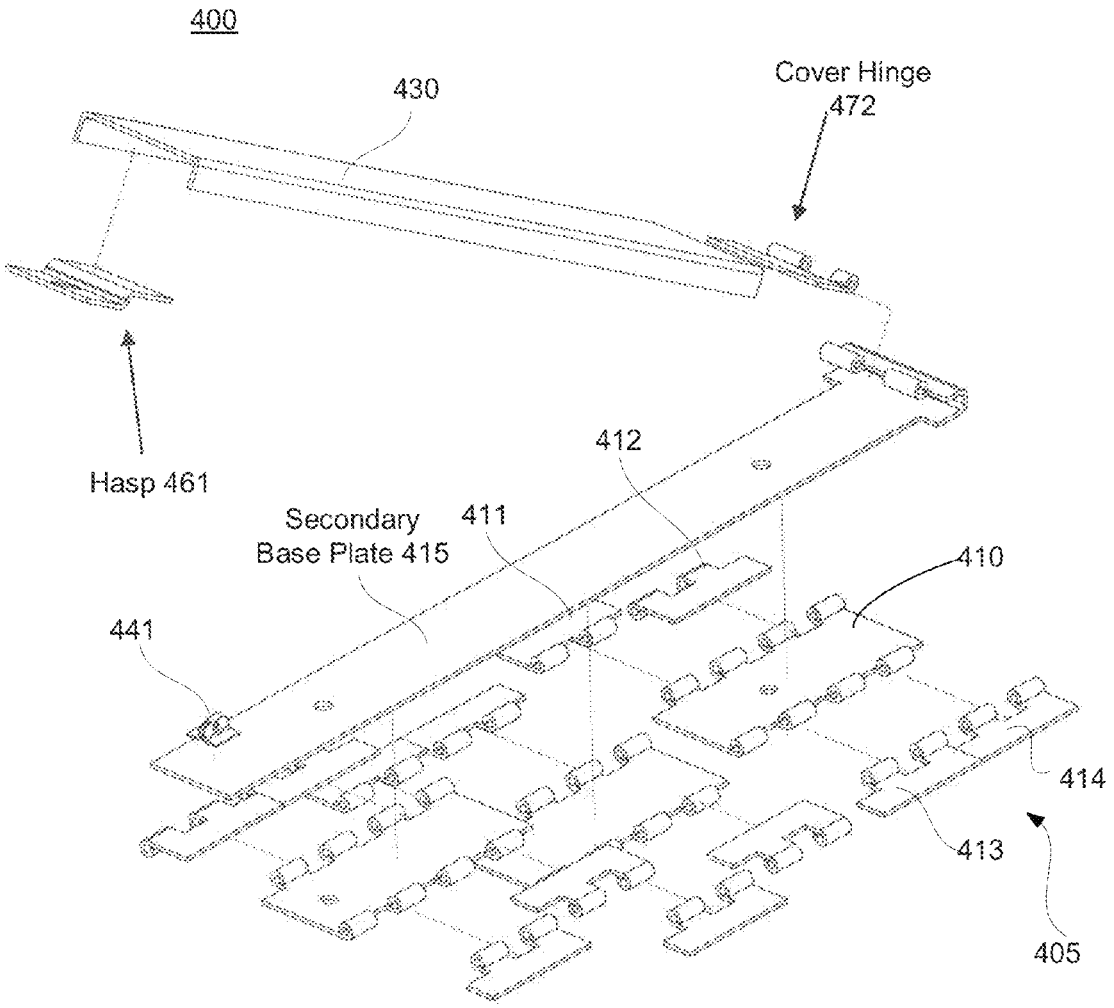
FIG. 19 depicts an exemplary modular aspect of the lockout device according to the fourth exemplary embodiment of the invention.
Figure 20:
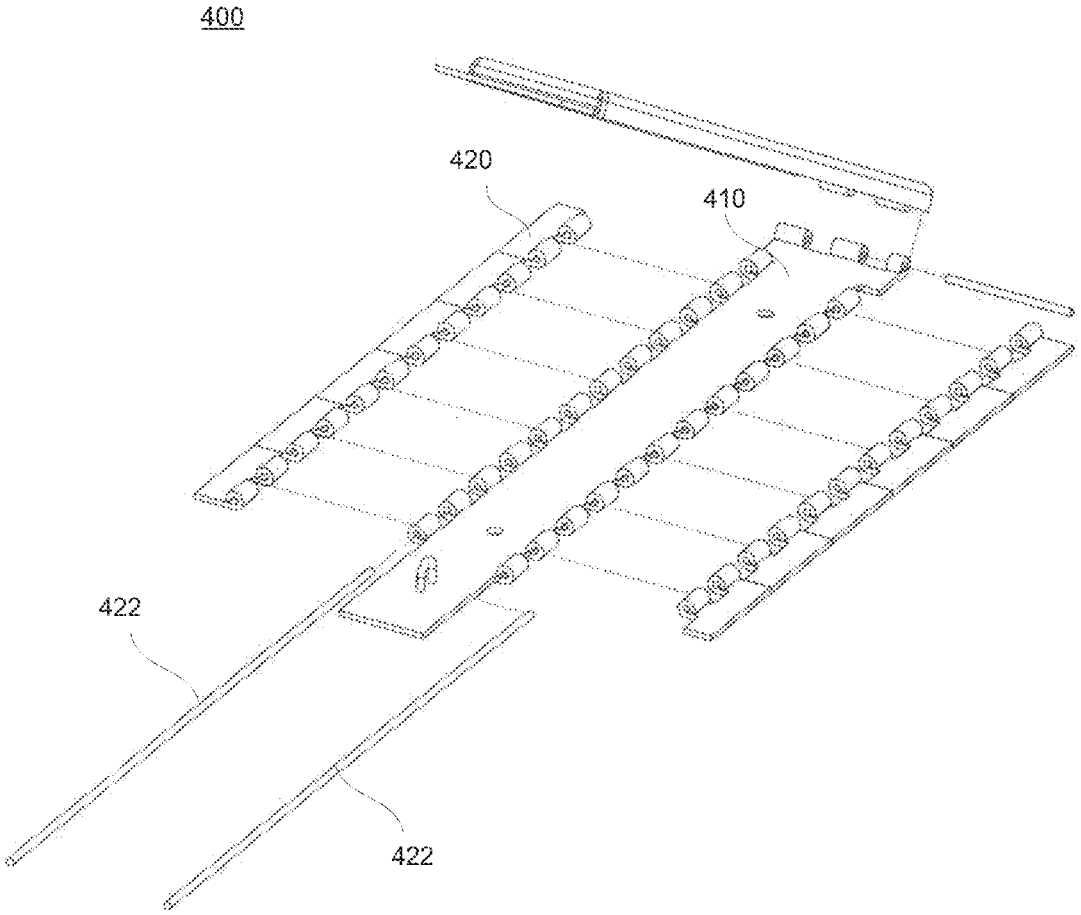
FIG. 20 depicts another view of the exemplary lockout device according to the fourth exemplary embodiment of the invention.

The lockout device 400 may be deployed on a number of circuit breaker panels which are similar in design with the exception of panel height. The size of a circuit breaker panel is driven by the number of branch circuits in the circuit breaker panel. A modular solution may be employed to cover a range of panel sizes (heights). FIGS. 19-20 depict an exemplary modular embodiment of device 400 that would allow the design to easily adapt to a range of panel sizes (heights) with a fewer number of unique parts. The exemplary embodiment may use, for example, a four circuit module 405 comprising base plates 410 and four hinged lockout tabs 411, 412, 413, 414 (two opposing pairs) for each base plate 410. A circuit module 405 with larger or smaller numbers of lockout tabs may be used, such as a two circuit module (single pair) or six circuit module (three pairs), for example. In the illustrated embodiment, three such modules 405 are assembled into a single device for locking out the breakers on a twelve breaker panel (four breakers for each of the three modules 405). The modules could, however, be assembled into circuit breaker lockout devices to fit any panel of similar design with multiple branch circuits. For example, in the four circuit module example, the modules could be applied to a panel having 4 circuits, 8 circuits, 12 circuits, 16 circuits, 24 circuits, etc. The modules 405 may be attached to a secondary base plate 415 to form a complete unit which can then be further reinforced as a unit with the circuit modules on each side of the device sharing a common hinge pin 422, as shown in FIG. 20. The individual four circuit modules 405 may be secured to the secondary base plate by, for example, spot welding or attached with a product such as 3M™ Very High Bond (VHB) double-sided tape. Many other standard attachment methods may be used. The locking cover subassembly 430 may include an integrated hinge barrel 471 in the cover as depicted in FIG. 16, or if a more modular approach is desired, the hinge may be a separate part 472 that is attached to the cover 430 by a fastener (e.g., screws, rivets, or welding). This would enable a modular solution such that the locking cover subassembly 430 can be easily produced in a channel shape, cut to the required length for a given circuit breaker panel size. Then a module hasp slot piece 461 may be attached to one end of the locking cover 430, and a hasp slot 441 may be attached to the secondary base plate 415. A corresponding hinge barrel may also be integral or attached to the secondary base plate 415 to complete the assembly, as depicted in FIG. 19.

With the various embodiments described above, a user may effectively prevent a circuit breaker switch from traveling into the closed position. The devices can easily be installed beside or on top of the circuit breaker switch in a circuit breaker panel with minimal clearance between the circuit breaker devices and the panel door cover.

It will be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the present invention and foregoing description thereof, without departing from the substance or scope of the invention.

While the foregoing illustrates and describes exemplary embodiments of this invention, it is to be understood that the invention is not limited to the construction disclosed herein. The invention can be embodied in other specific forms without departing from the spirit or essential attributes.

What is claimed is:

1. A lockout device for preventing a change in position of a circuit breaker, the circuit breaker having a two-position circuit breaker lever extending through a cutout in a panel cover, the lockout device comprising:

a first locking member having a first planar main body defining a first engagement edge, a first flange extending outward from the first planar main body, and at least one planar locking arm extending from the first planar main body and having a first locking passage formed therethrough, the first flange being parallel to but non-coplanar with the first planar main body and being configured for engaging an underside surface of the panel cover adjacent a side of the cutout when the first locking member is placed in a locking position, and the first engagement edge preventing movement of the circuit breaker lever from a first position to a second position of the two positions when the first locking member is placed in the locking position adjacent the circuit breaker; and a second locking member having a second planar main body and having a second flange extending outward from the second planar main body, the second flange being configured for engaging the underside surface of the panel cover adjacent an opposite side of the cutout when the second locking member is placed in a locking position, the second planar main body having a locking portion with a second locking passage formed therethrough, the locking portion being configured so that the second locking passage is in registration with the first locking passage when the first locking member and the second locking member are both placed in their locking positions, wherein the first planar main body has a first cutout formed therein, the first cutout being configured for passage over and around the circuit breaker lever, a portion of the first cutout defining the first engagement edge.

2. The lockout device according to claim 1, wherein the second flange is coplanar with the second planar main body.

3. The lockout device according to claim 1, wherein the second locking member is pivotably attached to the at least one planar locking arm so that the second planar main body is parallel to the at least one planar locking arm and rotatable from an unlocked position, in which the second flange does not engage the underside of the panel cover, to the locking position.

4. The lockout device according to claim 1, wherein the second planar main body has a second cutout formed therein, the second cutout being configured for passage over and around the circuit breaker lever and so that the first and second cutouts are in registration when the first and second locking members are in their locking position.

5. The lockout device according to claim 1, wherein the locking portion of the second locking member comprises at least one second planar locking arm extending from the second planar main body, the second locking passage being formed therethrough.

6. The lockout device according to claim 5, wherein the at least one second planar locking arm is pivotably attached to the at least one first planar locking arm adjacent the first flange so that the second locking member is pivotable relative to the first locking member between an unlocked position, in which the second flange does not engage the underside of the panel cover, and the locking position.

7. The lockout device according to claim 1, wherein the second flange is parallel to but non-coplanar with the second planar main body.

8. The lockout device according to claim 1, wherein the first locking member has a first tag hole that is in registration with a second tag hole in the second locking member when the first locking member and the second locking member are both placed in their locking positions.

9. A method for installing a lockout device to prevent a change in position of a two-position circuit breaker lever that extends through a cutout in a panel cover, the method comprising:

providing a first locking member having:

a first planar main body having a first cutout formed therein, a portion of the first cutout defining a first engagement edge, a first flange extending outward from the first planar main body such that the first flange is parallel to but non-coplanar with the first planar main body, and at least one planar locking arm extending from the first planar main body and having a first locking passage formed therethrough;

providing a second locking member having:

a second planar main body having a locking portion with a second locking passage formed therethrough, and a second flange extending outward from the second planar main body;

inserting the first flange through the panel cover such that the first flange engages an underside surface of the panel cover adjacent a first side of the cutout;

inserting the second flange through the panel cover such that the second flange engages the underside surface of the panel cover adjacent a second side of the cutout opposite the first side;

placing the first locking passage in registration with the second locking passage such that the first cutout is positioned around the circuit breaker lever and the first engagement edge prevents movement of the circuit breaker lever from a first position to a second position of the two positions.

10. A lockout device for preventing a change in position of a circuit breaker, the circuit breaker having a two-position circuit breaker lever extending through a cutout in a panel cover, the lockout device comprising:

a first locking member having a first planar main body defining a first engagement edge, a first flange extending outward from the first planar main body, and at least one planar locking arm extending from the first planar main body and having a first locking passage formed therethrough, the first flange being parallel to but non-coplanar with the first planar main body and being configured for engaging an underside surface of the panel cover adjacent a side of the cutout when the first locking member is placed in a locking position, and the first engagement edge preventing movement of the circuit breaker lever from a first position to a second position of the two positions when the first locking member is placed in the locking position adjacent the circuit breaker; and a second locking member having a second planar main body and having a second flange extending outward from the second planar main body, the second flange being configured for engaging the underside surface of the panel cover adjacent an opposite side of the cutout when the second locking member is placed in a locking position, the second planar main body having a locking portion with a second locking passage formed therethrough, the locking portion being configured so that the second locking passage is in registration with the first locking passage when the first locking member and the second locking member are both placed in their locking positions, wherein the second flange is coplanar with the second planar main body.

11. The lockout device according to claim 10, wherein the first planar main body has a first cutout formed therein, the first cutout being configured for passage over and around the circuit breaker lever, a portion of the first cutout defining the first engagement edge.

12. The lockout device according to claim 10, wherein the second locking member is pivotably attached to the at least one planar locking arm so that the second planar main body is parallel to the at least one planar locking arm and rotatable from an unlocked position, in which the second flange does not engage the underside of the panel cover, to the locking position.

13. The lockout device according to claim 10, wherein the first locking member has a first tag hole that is in registration with a second tag hole in the second locking member when the first locking member and the second locking member are both placed in their locking positions.

* * * * *